United States Patent [19]

Morenus et al.

[11] Patent Number: 4,573,648

[45] Date of Patent: Mar. 4, 1986

[54] RAM AIR COMBUSTION STEERING SYSTEM FOR A GUIDED MISSILE

[75] Inventors: Richard C. Morenus, Long Beach; Alson C. Frazer, Santa Ana, both of Calif.

[73] Assignee: Ford Aerospace and Communications Corp., Newport Beach, Calif.

[21] Appl. No.: 491,953

[22] PCT Filed: Jan. 20, 1983

[86] PCT No.: PCT/US83/00086

§ 371 Date: Jan. 20, 1983

§ 102(e) Date: Jan. 20, 1983

[87] PCT Pub. No.: WO84/02975

PCT Pub. Date: Aug. 2, 1984

[51] Int. Cl.[4] ..... F41G 7/00

[52] U.S. Cl. ..... 244/3.22; 102/503

[58] Field of Search ..... 102/229, 374, 380, 381, 102/503; 244/3.21, 3.22, 52; 60/270.1; 137/625.42, 625.46, 625.47, 862, 887, 15.1, 15.2, 874, 875, 876, 625.16

[56] References Cited

U.S. PATENT DOCUMENTS

| | | | |
|---|---|---|---|
| 2,324,551 | 7/1943 | Albree | 102/503 |
| 2,402,718 | 6/1946 | Albree | 102/50 |
| 2,836,378 | 5/1958 | Matthews | 91/530 |
| 2,989,922 | 6/1961 | Greenwood | 102/380 |
| 3,139,725 | 7/1964 | Webb | 60/35.54 |
| 3,208,383 | 9/1965 | Larson | 102/49 |
| 3,210,937 | 10/1965 | Perry, Jr. | 60/35.55 |
| 3,325,121 | 6/1967 | Banaszak et al. | 244/3.22 |
| 3,374,967 | 3/1968 | Plumley | 244/3.22 |
| 3,502,285 | 3/1970 | Gambill | 244/3.22 |
| 3,749,334 | 7/1973 | McCorkle, Jr. | 244/3.22 |
| 3,854,401 | 12/1974 | Fisher | 102/702 |
| 3,977,629 | 8/1976 | Tubeuf | 244/3.22 |
| 4,003,531 | 1/1977 | Fink | 244/3.22 |
| 4,186,899 | 2/1980 | Stewart, Jr. | 244/3.13 |
| 4,211,378 | 7/1980 | Crepin | 244/3.22 |
| 4,328,938 | 5/1982 | Reisman et al. | 244/3.1 |

FOREIGN PATENT DOCUMENTS

| | | | |
|---|---|---|---|
| 1426963 | 12/1965 | France | 244/3.22 |
| 2508414 | 12/1982 | France | 244/3.22 |

*Primary Examiner*—Charles T. Jordan

*Attorney, Agent, or Firm*—Paul K. Godwin, Jr.; Robert D. Sanborn

[57] ABSTRACT

An open-ended diffusion chamber and an adjacent combustion chamber located in the nose of a projectile to receive ram air that ignites a solid fuel material within the combustion chamber. A pair of oppositely disposed lateral steering ports are provided aft of the combustion chamber and are interconnected therewith via a diverting valve that is controllable to selectively divert the escaping combustion gases from the combustion chamber to one or both of the steering ports to thereby change or maintain the trajectory course of the projectile after firing.

10 Claims, 7 Drawing Figures

FIG. 1.
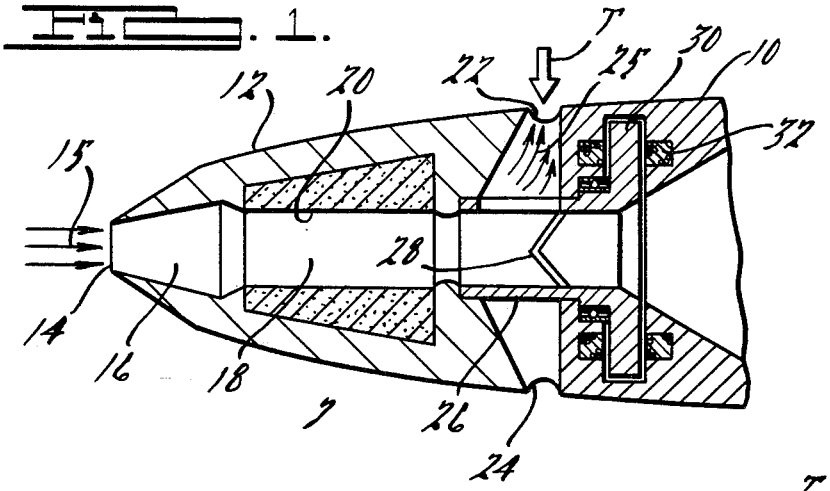
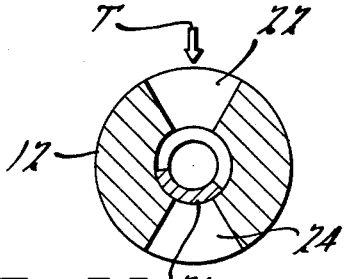
FIG. 2A.
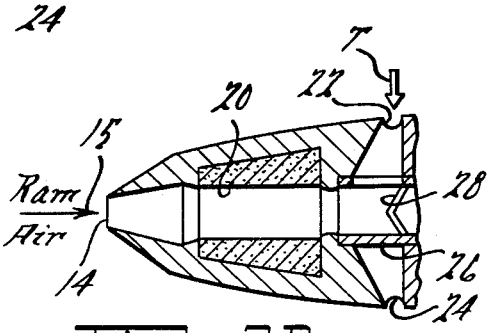
FIG. 2B.
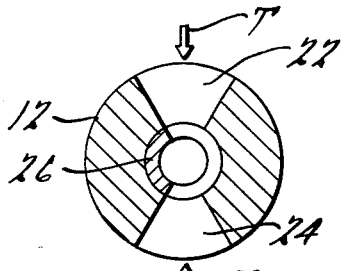
FIG. 3A.
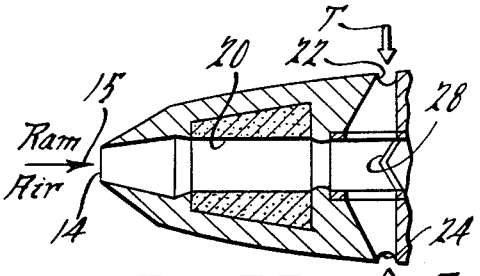
FIG. 3B.
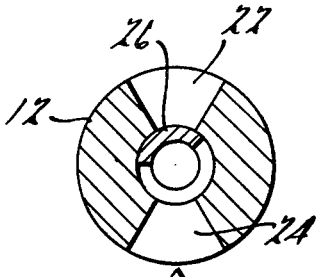
FIG. 4A.
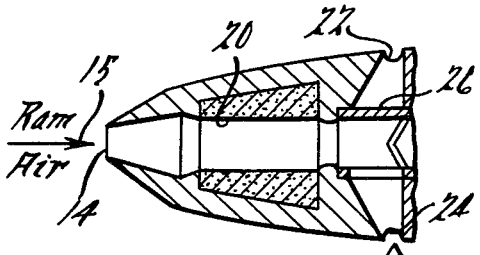
FIG. 4B.

RAM AIR COMBUSTION STEERING SYSTEM FOR A GUIDED MISSILE

CROSS-REFERENCE TO RELATED APPLICATION

The present invention is related to commonly-assigned and copending U.S. patent application Ser. No. 489,662.

TECHNICAL FIELD

The present invention is directed to the field of missile control systems and more specifically to the area of projectile steering through the use of lateral thrust steering ports.

BACKGROUND ART

Prior art techniques for providing steering control of projectiles and self-propelled missiles often employ side mounted thrust ports connected through adjustable control valves to self-contained sources of highly pressurized gases. Conventionally, such sources are either common to the fuel source that propels the missile or, in the case of fired projectiles, are separately ignited by an auxiliary device and dedicated to the steering function. Examples of the common fuel source missile steering techniques are shown in British Pat. No. 539,224; U.S. Pat. No. 3,139,725 and U.S. Pat. No. 3,210,937. An example of a separate fuel source for lateral steering is shown in U.S. Pat. No. 3,749,334.

DISCLOSURE OF THE INVENTION

The present invention is presently configured for use in the forward portion of a projectile type missile to provide controlled lateral thrust steering.

Lateral steering control is an important feature in projectile guidance systems. In such systems, each projectile is fired from a gun towards a target and is guided to the target via an informational beam of energy radiated from a source, usually at the firing location. The informational beam contains locational codes by which the projectile, upon receipt of a particular code, will compute appropriate steering commands to correct the flight path. An example of a guidance system utilizing an informational beam is illustrated in commonly-assigned U.S. Pat. No. 4,186,899.

The present invention utilizes ram air for thermodynamic ignition of a solid fuel and provides means for selectively diverting the resulting combustion gases to one or more lateral thrust steering ports. The diverting means, in this instance, comprises a controllable vane that is rotatably mounted to block one or the other of two oppositely disposed ports or to allow equal passage of the combustion gases to both ports. The vane position is controlled by electrical signals derived by an associated circuit within the projectile. Although the circuit is not shown as part of the invention, its function is to provide appropriate signals to control the vane position in accordance with the steering correction information in the informational beam and vertical reference information derived on-board. A roll reference sensor, such as that shown in commonly-assigned U.S. Pat. No. 4,328,938, is appropriate to provide the necessary vertical reference information to the circuit.

BRIEF DESCRIPTION OF THE DRAWINGS

FIG. 1 is an elevational corss-section view of the forward portion of a projectile incorporating the present invention.

FIGS. 2A and 2B illustrate the diverting valve of the present invention positioned to provide downward steering thrust for the projectile shown in FIG. 1.

FIGS. 3A and 3B illustrate the diverting valve of the present invention positioned to provide equal and opposite lateral thrust for the projectile shown in FIG. 1.

FIGS. 4A and 4B illustrate the diverting valve of the present invention positioned to provide upward steering thrust for the projectile shown in FIG. 1.

BEST MODE FOR CARRYING OUT THE INVENTION

The forward end of a projectile 10 is shown in FIG. 1 in elevational cross-section. The forward end includes a nose member 12 that is symmetrically formed to contain the preferred embodiment. The nose member includes a ram air inlet 14 that opens to a diffusion chamber 16.

During flight, high velocity air enters through the inlet 14 at the forward end of the diffusion chamber 16 where velocity energy of the ram air is converted into pressure energy, thereby raising the temperature. For example, a projectile of this configuration traveling at approximately Mach 3 will have ram air raised to a temperature in the range of 600°–1000° F.

A combustion chamber 18 is formed aft and adjacent the diffusion chamber 16. Together, the two cylindrical chambers define a compression chamber. The combustion chamber 18 is cylindrically shaped and coaxial with the longitudinal axis of rotation of the projectile 10. The combustion chamber 18 has walls formed of a solid fuel material 20 that is ignited and self-sustained for combustion by the high temperature of the ram air entering the combustion chamber 18 from the diffusion chamber 16. As the fuel is heated, it produces gases which combine chemically with the ram air to increase the temperature and pressure within the combustion chamber 18.

A pair of oppositely disposed lateral thrust steering ports 22 and 24 are provided aft of the combustion chamber 18 to allow the combustion gases flowing from the combustion chamber 18 to escape in a direction having a vector component normal to the projectile flight path.

A movable vane element 26 is mounted on a rotatable base 30 so as to be positionable between the combustion chamber 18 and the ports 22 and 24. The vane element 26 is partially cylindrical in shape and is movable about its cylindrical axis which is coaxial with the projectile axis of rotation. A diverting surface 28 is located at the cylindrical axis so as to divert gasses from the combustion chamber 18 away from the vane element 26 and towards one or more of the ports 22 and 24.

The rotatable base 30 is driven by electromagnetic forces and forms pat of a step-actuated motor that is actuated by electrical signals applied to drive coils 32.

In operation, the present invention is suited for use in projectiles fired at sea level and at higher altitudes where the air is relatively thin. The combustion gases provide augmented thrust for steering by the addition of thermal energy.

At firing, the projectile is at its maximum speed. The ram air entering the inlet 14 is raised in temperature by the diffusion chamber 16. It ignites the exposed surface of the solid fuel 20 and supplies oxygen to sustain combustion of that fuel in the combustion chamber 18. The gases produced by the burning fuel are forced towards the steering ports 22 and 24 by the configuration of the combustion chamber 18, the incoming ram air and the relatively low pressure of external air flowing over the ports 22 and 24.

As shown in FIGS. 2A and 2B, when it is desired to command the projectile to be steered in a downward direction, the vane element 26 is rotated to the relative position shown. In that position, the gases will be diverted upwards when ports 22 and 24 rotate into the appropriate upwardly oriented position. In this fashion, the escaping gases produce downward steering thrust T on the nose 12.

When no steering correction is required, the vane element 26 is positioned as shown in FIGS. 3A and 3B so that equal thrust is generated by gases diverted to escape through both ports 22 and 24.

The relative position of the vane 26 in FIGS. 4A and 4B provides for upward thrust by diverting the escaping combustion gases downward as the ports 22 and 24 roll into position.

It will be readily apparent that many modifications and variations may be implemented without departing from the scope of the novel concept of this invention. Therefore, it is intended by the appended claims to cover all such modifications and variations which fall within the true spirit and scope of the invention.

We claim:

1. A directional steering system for a guided missile comprising:

means defining the nose end of said missile;

means within said nose means for receiving ram air therein;

means within said nose means adjacent said ram air receiving means for providing combustible fuel;

means within said nose means defining a combustion chamber wherein ram air ignites said fuel;

means within said nose means and aft of said combustion chamber defining lateral thrust steering ports to provide escape paths for combustion gases from said combustion chambers means to the external environment;

means within said nose means for selectively diverting combustion gases generated within said combustion chamber means to one or more of said lateral thrust steering ports.

2. A steering system as in claim 1, wherein said combustible fuel means comprises a quantity of solid fuel formed to have a surface exposed to said ram air in said combustion chamber means.

3. A steering system as in claim 1, wherein said diverting means includes an electrically controllable vane mechanism that is rotatable to completely block no more than one of sad lateral thrust steering ports at a time.

4. A system for directionally controlling a fired projectile over its flight path comprising:

means at the nose end of said projectile for defining a compression chamber having one end open for receiving ram air;

a pair of oppositely disposed jet ports extending from said compression chamber means to opposite sides of said projectile;

means defining a solid combustible fuel within said compression chamber means and being ignited by said ram air to produce combustion gases;

valve means between said compression chamber means and said jet ports for responsively diverting the flow of combustion gases to each of said jet ports to control the steering direction of said projectile.

5. A system as in claim 4, wherein said compression chamber means includes an internal wall surface which is formed by a solid fuel material, and further wherein, said solid fuel material is ignited by said ram air within said compression chamber means and generates combustion gases that are forced towards said pair of jet ports to escape therefrom and thereby provide steering thrust to said projectile.

6. A system as in claim 5, wherein said compression chamber means is generally cylindrically shaped and lies longitudinally concentric with the major axis of said projectile and further wherein said jet ports extend radially with respect to said compression chamber means.

7. A system as in claim 6, wherein said valve means comprises a partially cylindrical vane element on a rotatable base that is electrically controlled and wherein said element is mounted for axial rotation along the axis of said projectile.

8. A system as in claim 6, wherein said vane element is at least large enough to block one of said jet ports when located between it and said combustion chamber means and sufficiently small enough to leave both said jet ports open when equal thrust is desired at each jet port.

9. A system as in claim 4, wherein said compression chamber means is generally cylindrical shaped and lies longitudinally concentric with the major axis of said projectile and further wherein said jet ports extend radially with respect to said compression chamber means.

10. A system as in claim 8, wherein said valve means comprises a partially cylindrical vane element on a rotatable base that is electrically controlled and wherein said element is mounted for axial rotation along the axis of said projectile.

* * * * *